US006672818B1

(12) United States Patent
Terracol et al.

(10) Patent No.: US 6,672,818 B1
(45) Date of Patent: Jan. 6, 2004

(54) MAGNETICALLY DRIVEN PUMP

(75) Inventors: Claude Terracol, Brie Angonnes (FR); Jean Guy Villette, Fontaine (FR)

(73) Assignee: Societe Siebec, Fontaine (FR)

( * ) Notice: Subject to any disclaimer, the term of this patent is extended or adjusted under 35 U.S.C. 154(b) by 56 days.

(21) Appl. No.: 10/069,358

(22) PCT Filed: Sep. 6, 2000

(86) PCT No.: PCT/FR00/02446

§ 371 (c)(1),
(2), (4) Date: Mar. 5, 2002

(87) PCT Pub. No.: WO01/18401

PCT Pub. Date: Mar. 15, 2001

(30) Foreign Application Priority Data

Sep. 6, 1999 (FR) ..... 99 11242

(51) Int. Cl.[7] ..... F04B 17/00; F16D 19/00
(52) U.S. Cl. ..... 412/420; 192/84.1
(58) Field of Search ..... 417/420, 423.8; 192/84.1, 84.3

(56) References Cited

U.S. PATENT DOCUMENTS

| | | | | | |
|---|---|---|---|---|---|
| 3,172,364 A | * | 3/1965 | Barotz | ..... | 417/420 |
| 4,207,485 A | | 6/1980 | Silver | | |
| 4,645,432 A | | 2/1987 | Tata | | |
| 5,501,582 A | * | 3/1996 | Gautier et al. | ..... | 417/420 |
| 5,833,437 A | * | 11/1998 | Kurth et al. | ..... | 417/36 |

FOREIGN PATENT DOCUMENTS

| | | | | |
|---|---|---|---|---|
| DE | 39 27 391 A1 | | 2/1991 | |
| FR | 2 311 201 A | | 12/1976 | |
| JP | 1-125591 | * | 5/1989 | ..... F04D/13/02 |
| WO | WO 99/10655 | | 3/1999 | |

* cited by examiner

*Primary Examiner*—Cheryl J. Tyler
*Assistant Examiner*—Timothy P. Solak
(74) *Attorney, Agent, or Firm*—Oliff & Berridge, PLC

(57) ABSTRACT

A magnetically driven pump comprises a sealing partition 48 whereof the central portion forms the rotational axis of the rotating portion of the pump, that central portion being itself supported and centered by a rotating connection piece 42 linked to or integral with drive shaft 41 of the motor 29.

12 Claims, 2 Drawing Sheets

PRIOR ART

MAGNETICALLY DRIVEN PUMP

TECHNICAL FIELD OF THE INVENTION

The invention concerns a magnetically driven pump comprising:

- a pump element fitted with a first driven rotor in the form of a wheel mounted to rotate in a body connected to the suction and discharge piping,
- a first series of magnets integral with the first rotor,
- a driving motor fitted with a drive shaft on which is mounted a second driving rotor carrying a second series of magnets., both series of magnets being laid out concentrically to provide rotation magnetic coupling,
- and a sealing device having a fixed partition extending in the gap between both series of magnets while providing tight separation between the pump element and the motor.

The sealing partition is particularly important when the pumped liquid exhibits a corrosive nature, which is frequently the case in chemistry or electroplating.

For these applications, that do not lend themselves to stoppages readily, it should be noted that maintenance operations must be as short as possible, if not suppressed altogether.

PRIOR ART

The pumps used currently can be classified in two categories:

- pumps fitted with a sealing gasket (FIG. 1), comprising friction pieces mounted fixed on the one hand, and rotating on the other hand, whereas the nature of the materials considered and the quality of their surface condition enable to obtain satisfactory sealing properties;
- magnetically driven pumps (FIG. 2), which have been designed to remedy the shortcomings mentioned above, whereas sealing is provided not by friction pieces any longer, but by a continuous partition. On either side of that partition, there are a driving rotor linked to the motor, and a driven rotor linked to the wheel of the pump. Both rotors concern magnets laid out so that they provide a magnetic coupling between both rotors.

On FIG. 1, the motor 1 is linked to the centrifugal wheel 2 by an axis 3 and a rigid coupling device 4. The wheel 2 rotates in the pump body 5 that communicates with the suction 6 and discharge 7 piping. The pump body is sealed to the passageway of the spindle 3 thanks to the friction joint 8.

The first fault that can be ascribed to that type of pump is that the friction pieces forming that joint are exposed to wear and that they must therefore be replaced periodically, which involves downtimes for maintenance purposes. This replacement operation is even trickier since the joint 8 is situated in a hardly accessible zone.

A second potential fault is the sealing effect properly speaking that cannot be guaranteed perfectly, because of the small surface defects that may be encountered on friction bearing faces, and of the inevitable formation of a liquid film between these surfaces.

FIG. 2 shows the motor 11, the wheel 12, the pump body 15, the suction 16 and discharge 17 piping. Sealing is here provided by the continuous partition 18 assembled rigidly and hermetically between the pump body 15 and the spacer 19 providing the necessary link with the flange of the motor 11. On the spindle of the motor 11 is mounted rigidly the driving rotor 20 in which is inserted, for example by duplicate molding, a series of magnets 21.

The driven rotor 22 integral with the wheel 12 is equipped with a series of magnets 23. The magnets 21, 23 are organized so that a driving side north pole faces a driven side south pole, and conversely. There is thus provided a magnetic coupling without any mechanical contacts, a coupling that must therefore be sufficient to sustain the maximum torque absorbed by the wheel without stalling.

Good efficiency of the coupling requires that the gap between both families of magnets should be as little as possible. This gap being formed by the thickness of the partition 18 and by the plays either side of the said partition, it appears that the following targets should be reached:

- to minimize the thickness of the partition, which implies that it should not be stressed excessively from a mechanical viewpoint and/or that it is made of a material with good stiffness;
- to reduce the plays, which implies good dimension stability of the parts affected, as well as their positioning.

About the first item, there may be a contradiction between mechanical stability of the partition and its chemical compatibility with the pumped liquid, with which it is in contact by its internal face.

A solution widely used consists in realizing that partition by juxtaposing two materials:

- externally, an a magnetic metal portion providing precision and stiffness.
- internally, a portion made of chemically compatible synthetic material.

Such arrangement solves the problem rather well, but it exhibits two significant shortcomings:

- an increase in thickness, and hence in the gap.
- the presence of Foucault currents in the metal partition, these currents being induced by the rotation of the flux of the magnets. These Foucault currents form a heating source that may become prohibitive, notably for large plants.

As regards the second item, i.e. the plays, the positioning and rotation guiding device of the wheel 12 according to FIG. 2, is formed:

- of a fixed spindle 24, mounted with stiffness and precision on the partition 18,
- of a fixed ring 25 integral with the spindle 24,
- and of a rotating ring 26 integral with the wheel 12.

The quality and the arrangement of the rings 24, 25 are obviously essential to the stability of the pump, with notably:

- as generous sizing as possible of the surfaces in contact.
- judicious selection of the materials (ceramic, silicon carbide, graphite . . . ) and of their surface condition.
- judicious use of the pumped liquid to ensure lubrication
- as good an evacuation as possible of the calories generated by friction.

Inspection of FIG. 2 shows clearly the shortcomings inherent to the assembly of the spindle 24 as regards precision, hence control of the plays. Its positioning with respect to the axis of the motor (with which it must be aligned theoretically) is provided indeed by two parts whereof the precision and stiffness may be problematic: the spacer 19 and especially the partition 18. It has been observed that said partition must be thin enough to go through the gap and not generate too many Foucault currents.

It will be therefore quite difficult to embed the spindle 24 correctly. It has been suggested to improve the mechanical stability while providing an additional bearing at the other end of the wheel, but that solution increases the complexity notably without solving the problem adequately.

Finally, as regards the evacuation of the calories absorbed by the spindle 24, it should be noted that it must be performed through the partition 18 that does not lend itself very well to that process, still because of its excessive thinness.

The document FR-A-2311201 describes a magnetically driven pump, wherein the turbine is equipped with a magnetic core and is driven by the magnetic crown through a tight partition. The rotating turbine is supported by a fixed shaft, which is guided by a pair of bearings on the magnetic crown in connection with the motor shaft. The presence of the bearings on top of the output bearing of the motor shaft causes the assembly to overhang significantly and to be embedded even more. The axial space requirements of the pump are important, and the positioning of the shaft of the turbine does not enable to obtain perfect alignment.

OBJECT OF THE INVENTION

The object of this patent is to suggest a solution enabling to remedy the above shortcomings, i.e. ensure on the one hand perfect centering of the rotational axis of the wheel of the pump, while relieving the sealing partition from that function, and on the other hand while seeking efficient evacuation of the calories toward a cooling element.

The pump according to the invention is characterized in that:

- the first driven rotor revolves on a cylindrical shoulder whereof the positioning and support are provided by an axial connection piece extending in the continuation of the shaft of the motor,
- a female cylindrical bearing serves as a concentric recess for the connection piece in order to provide mechanical support and accurate centering of the partition and of the first driven rotor.

The spindle of the motor is continued advantageously by a sufficient length to enable said spindle to engage inside the driven rotor. It results that the spindle of the motor encompasses the spindle of the wheel which, from fixed becomes rotating. The purpose is obviously not to obtain that rotation, but to provide the first driven rotor with a stiff support that is aligned perfectly with the motor spindle.

According to a preferred embodiment, the first driven rotor comprises a second ring that rotates on a first ring integral with the fixed partition. The bearing integral with the partition comprises at least one self-lubricating ring forming a thermal bridge for the evacuation of the calories generated by the rotation of the first driven rotor towards the heater formed by the motor shaft.

As the sealing partition should remain undisturbed, its shape must be made slightly more complex so that it may run around the extended connection piece, which belongs to the zone outside the pumping circuit, whereas the spindle 24 according to FIG. 2 of the previous art was part of the internal zone.

On top of the cylindrical portion in the gap, the partition should therefore exhibit a second cylindrical portion engaging on the end of the motor spindle, with interposition of a friction bushing, made for example of self-lubricating material.

As that spindle now ensures the positioning of the driven rotor with the requested precision and stiffness, that function need not be fulfilled by the sealing partition, which can be consequently be made lighter. In the easiest embodiment, that partition can be made of a single part, in a material chemically compatible with the pumped liquid.

It should be noted however that the part must remain capable to sustain the pressure of the liquid present around the driven rotor, a pressure that is significant since it can be close to the discharge pressure of the pump. In case when that pressure is high and when there is no material chemically compatible exhibiting sufficient mechanical stability, one can be led to consider a composite partition comprising a mechanical resistant external envelope and a chemically compatible internal envelope.

One is not however exposed to the same constraints as with conventional pumps corresponding to FIG. 2. Indeed, stability to internal pressure is much easier to ensure than stiffness and precision.

The external envelope can then be much thinner, which enables to contemplate its realization:

- either in a magnetic metal, as in the conventional solution, but by selecting very small thickness, which brings the losses caused by Foucault currents to its acceptable value;
- or in synthetic material (loaded polyamide or polycarbonate for example), which calls for moderate increase in the gap, but suppresses Foucault currents totally.

As regards the evacuation of the calories generated by the rotation, the arrangement described above exhibits an obvious advantage, inasmuch as it produces a thermal bridge with large cross-section and little thickness between the bearing of the driven rotor and the shaft of the motor. Obviously, this advantage is mitigated by the fact that the calories produced by the rotation of the additional connection piece of the shaft of the motor in its own bearing should be evacuated, but this position lies outside the reach of the pumped liquid, which enables to use conventional mechanical components, whereof the output is excellent.

According to another characteristic of the invention, the sealing partition is formed for better chemical compatibility, whereas precision and mechanical stability are ensured by an additional part matching partially the shape of the partition, and realized in a material with good mechanical stability. The additional part can be realized in metal alloy, notably stainless steel, and comprises a ferrule inserted in the gap provided between both series of magnets. The thickness of the ferrule is smaller than that of the envelope of the partition.

BRIEF DESCRIPTION OF THE DRAWINGS

Other advantages and characteristics will appear more clearly using the following description with the appended drawings, given for non limitative exemplification purposes, and wherein.

DESCRIPTION OF A PREFERRED EMBODIMENT

Figure 1:
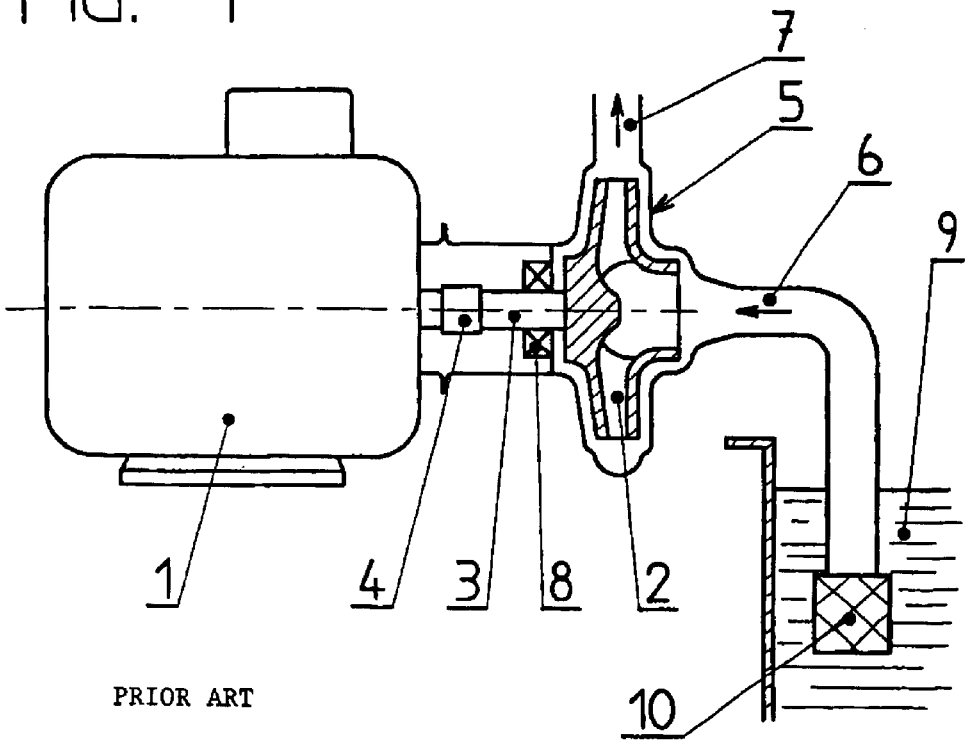
FIG. 1 represents a schematic elevation view of a conventional power-driven pump assembly with a friction sealing gasket.
Figure 2:
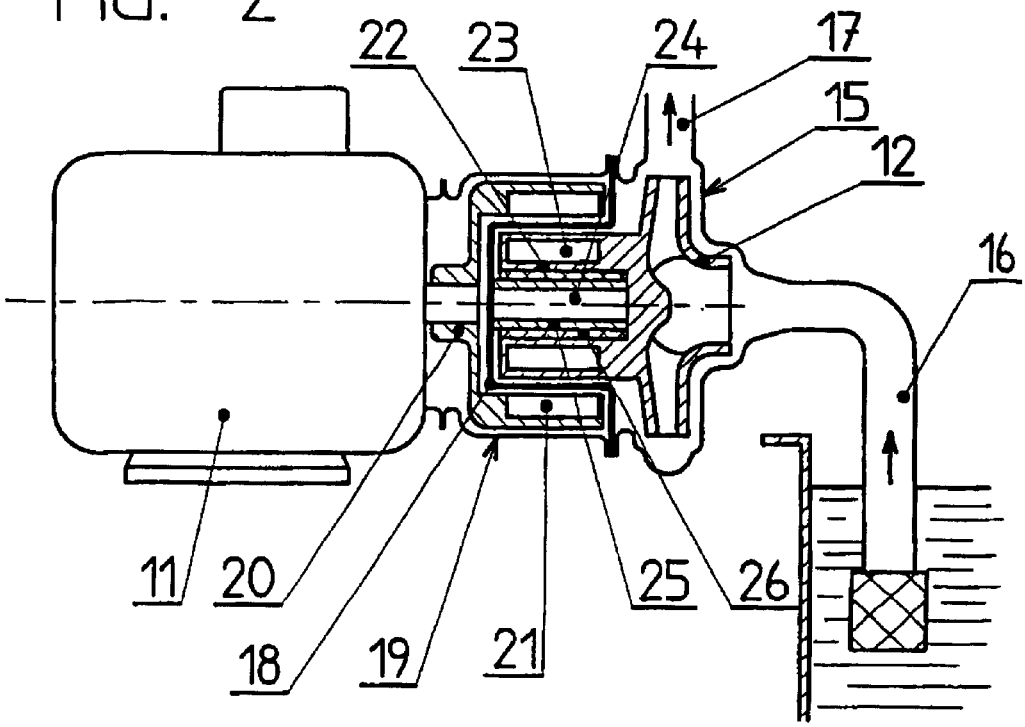
PRIOR ART FIG. 2
FIG. 2 represents a schematic elevation view of a conventional magnetically power-driven pump assembly.
Figure 3:
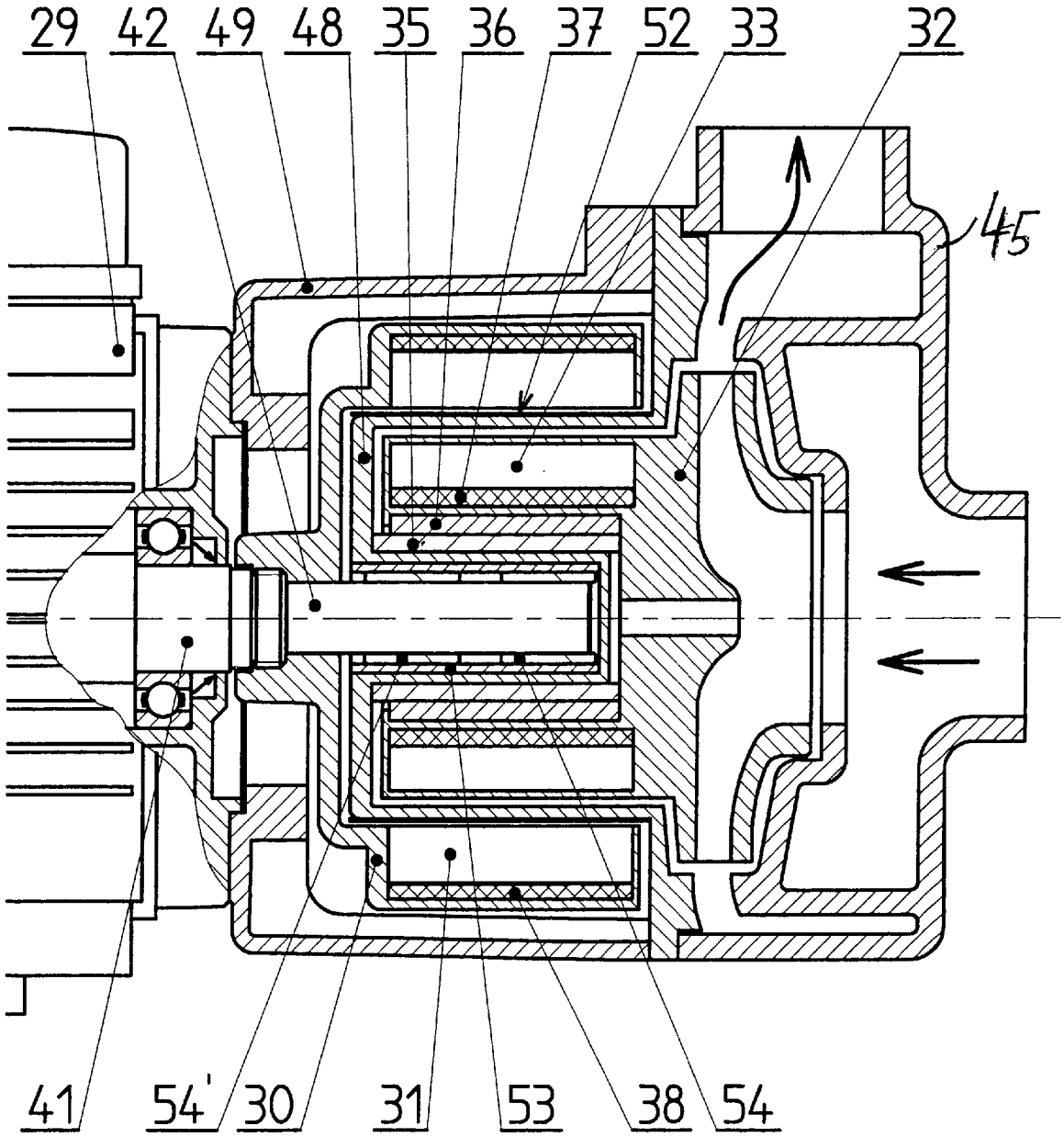
FIG. 3 represents an elevation view and a cross-sectional view of a magnetic drive according to the invention.

This embodiment is illustrated by FIG. 3 wherein can be seen:

the driving motor 29, the wheel of the first driven rotor 32, equipped with the first series of magnets 33 and a steel tube 37, the second driving rotor 30, equipped with the second series of magnets 31 and a steel tube 38, the tubes 37 and 38 being designed for looping the magnetic flux of the permanent magnets 31, 33, the tubes 37, 38 and the magnets 31, 33 are fixed respectively on the second rotor 30 and on the wheel 32 by any appropriate means, notably by duplicate molding, the fixed ring 35 and the rotating ring 36 forming the rotational bearing of the wheel, the pump body 45, and the spacer 49 providing the link between the motor 29 and the pump body 45.

A connection piece 42 lies in the continuation of the motor shaft 41, with which it may be integral, or on which it can be assembled with stiffness and precision. On top of its first function, which is to support and to centre the wheel of the pump, the connection piece 42 is laid out to accommodate the fastening of the second driving rotor 30, that fastening being provided by any appropriate mechanic means.

The sealing partition consists of an envelope 48 made of a material chemically compatible with the pumped liquid, and of a cylindrical ferrule 52 made of a mechanically resistant material, notably stainless steel. That ferrule enables to provide the necessary stability to the internal pressure, inasmuch as the material forming the envelope 48 can be insufficiently resistant. The envelope 48 extends inwardly by a part forming a sheath, in which engages axially the connection piece 42.

In that central zone, the envelope 48 carries:

externally, the fixed ring 35, on which rotates the wheel 32, by means of its integral ring 36.

internally, a steel sheath 53, in which the self-lubricating rings 54, 54' will be shrunk, which engage themselves on the connection piece 42.

The ring 35 and the sheath 53 can be advantageously duplicated by molding in the envelope of the partition 48 when said partition is molded.

The ring 35, and the wheel of the rotor 32 are now centered with precision by the connection piece 42. There results good concentricity of the parts 35, 53, 54, 54', and the play between the connection piece 42 and the bushings 54, 54' is quite small.

The sealing partition is therefore totally relieved of the centering function and hence need not be very stiff. It is conversely advisable that it exhibits some flexibility in order not to impede the centering imposed by the connection piece 42.

In addition to the centering function, the device of FIG. 3 enables good external evacuation of the calories generated by the rotation of the wheel of the rotor 32, the motor shaft 41 acting as a heater by means of the connection piece 42. The calories go through the parts 35, 48, 53, 54 and 54' in succession, but all these transfers involve small thicknesses and large cross sections, which leads to sufficiently efficient thermal bridge.

As a variation, it can be contemplated to replace the bushings 54, 54' with the needle bearings. That solution will be particularly interesting if high resistance and extended lifetime are required. Conversely, it will be less efficient from the thermal bridge viewpoint. Composite solutions combining friction bushings and needle bearings can also be contemplated.

What is claimed is:

1. A magnetically driven pump comprising:

a pump element fitted with a first rotor in the form of a wheel mounted to rotate in a body connected to a suction and discharge piping, a first series of magnets integral with the first rotor, a driving motor fitted with a drive shaft on which is mounted a second rotor carrying a second series of magnet, both series of magnets being laid out concentrically to provide a rotation magnetic coupling, a sealing device having a fixed partition extending in a gap between both series of magnets while providing tight separation between the pump element and the driving motor, and a connection piece connected to the drive shaft, wherein the connection piece is continued axially by a sufficient length to insert the connection piece inside a female cylindrical bearing in a core of the first rotor to provide mechanical support and accurate centering of the fixed partition and of the first rotor.

2. A pump according to claim 1, wherein the first rotor comprises a second ring which rotates on a first ring integral with the fixed partition.

3. A pump according to claim 2, wherein the bearing integral with the fixed partition comprises at least one self-lubricating ring, forming a thermal bridge for the evacuation of the calories generated by the rotation of the first rotor.

4. A pump according to claim 2, wherein the bearing comprises needle bearings resting on the connection piece.

5. A pump according to claim 1, wherein the bearing integral with the fixed partition comprises at least one self-lubricating ring, forming a thermal bridge for the evacuation of the calories generated by the rotation of the first rotor.

6. A pump according to claim 1, wherein the bearing comprises needle bearings resting on the connection piece.

7. A pump according to the claim 1, wherein the fixed partition is a monobloc part in a material that is chemically compatible with the pumped liquid, and possesses sufficient mechanical stability to sustain the pressure of the pumped liquid.

8. A pump according to claim 1, wherein the fixed partition has an envelope formed for better chemical compatibility, while precision and mechanical stability are provided by an additional part matching partially shape of the fixed partition and made of a material with good mechanical stability.

9. A pump according to claim 8, wherein the additional part is made of metal alloy, and comprises a ferrule engaging into the gap provided between both series of magnets.

10. A pump according to claim 9, wherein the thickness of the ferrule is smaller than that of the envelope of the fixed partition.

11. A pump according to claim 9, wherein the metal alloy is stainless steel.

12. A pump according to claim 11, wherein the thickness of the ferrule is smaller than that of the envelope of the fixed partition.

* * * * *